US011325744B2

(12) United States Patent
Shih

(10) Patent No.: US 11,325,744 B2
(45) Date of Patent: May 10, 2022

(54) CARTON BOX WITH FAST PACKAGING FUNCTION

(71) Applicant: Meng-Hung Shih, Taichung (TW)

(72) Inventor: Meng-Hung Shih, Taichung (TW)

( * ) Notice: Subject to any disclaimer, the term of this patent is extended or adjusted under 35 U.S.C. 154(b) by 0 days.

(21) Appl. No.: 16/999,364

(22) Filed: Aug. 21, 2020

(65) Prior Publication Data

US 2022/0055793 A1 Feb. 24, 2022

(51) Int. Cl.

| | |
|---|---|
| ***B65D 5/64*** | (2006.01) |
| ***B65D 5/02*** | (2006.01) |
| ***B65D 5/42*** | (2006.01) |

(52) U.S. Cl.

CPC ..... *B65D 5/643* (2013.01); *B65D 5/02* (2013.01); *B65D 5/425* (2013.01)

(58) Field of Classification Search

CPC ..... B65D 5/643; B65D 5/02; B65D 5/425; B65D 5/6647; B65D 5/6611; B65D 5/2066; B65D 5/423; B65D 45/00

USPC ... 229/116.1, 125.39, 125.37, 125.33, 198.3; 24/563, 570; 292/288; 220/315, 324

See application file for complete search history.

(56) References Cited

U.S. PATENT DOCUMENTS

| | | | | |
|---|---|---|---|---|
| 1,909,654 | A * | 5/1933 | Brown | B65D 5/6647 24/580.1 |
| 2,233,666 | A * | 3/1941 | Jinkerson | B65D 5/643 229/102 |
| 4,333,602 | A * | 6/1982 | Geschwender | B65D 5/6611 229/125.39 |
| 5,743,461 | A * | 4/1998 | Timmins | B65D 5/643 206/386 |
| 7,854,372 | B1 * | 12/2010 | Bartone, Sr. | B65D 5/4283 229/125.39 |
| 8,701,975 | B2 * | 4/2014 | Farris | B65D 5/6647 229/125.39 |
| 9,321,566 | B2 * | 4/2016 | Weber | B65D 5/2066 |
| 10,737,829 | B1 * | 8/2020 | Wilson | B65D 5/643 |

* cited by examiner

*Primary Examiner* — Christopher R Demeree

(74) *Attorney, Agent, or Firm* — Karin L. Williams; Alan D. Kamrath; Mayer & Williams PC

(57) ABSTRACT

A carton box includes a main body and at least one fastening module removably mounted on the main body. The main body includes two first face boards and two second face boards. One of the first face boards is provided with a first movable plate. The other one of the first face boards is provided with a second movable plate. The main body is provided with at least one locking slot. The at least one fastening module includes a first fastener member mounted on the second movable plate and a second fastener member located in the at least one locking slot of the main body. The second fastener member is detachably connected with the first fastener member.

6 Claims, 5 Drawing Sheets

CARTON BOX WITH FAST PACKAGING FUNCTION

BACKGROUND OF THE INVENTION

1. Field of the Invention

The present invention relates to a packaging and, more particularly, to a carton box.

2. Description of the Related Art

A conventional carton box in accordance with the prior art shown in FIG. 5 comprises a box body 10 having a top provided with two movable cardboards 11 and 12, and an adhesive tape 13 adhered to the box body 10 to seal the two movable cardboards 11 and 12. In packaging, the two movable cardboards 11 and 12 are bent and juxtaposed to each other, and the adhesive tape 13 are stuck to the two movable cardboards 11 and 12 and the peripheral wall of the box body 10, to seal the conventional carton box. However, the adhesive tape 13 increase the packaging cost of the conventional carton box. In addition, the adhesive tape 13 cannot be stripped from the box body 10 easily, thereby causing inconvenience to the user in dismantling of the conventional carton box. Further, the outer appearance of the box body 10 is broken after the adhesive tape 13 is stripped from the box body 10, such that the conventional carton box cannot be used again after the articles in the box body 10 are not accepted by the consumer and have to be returned to the sender.

BRIEF SUMMARY OF THE INVENTION

The primary objective of the present invention is to provide a carton box with a fast closing and packaging function.

In accordance with the present invention, there is provided a carton box comprising a main body and at least one fastening module removably mounted on the main body. The main body includes two opposite first face boards and two opposite second face boards. Each of the two first face boards has a lower end provided with a first bottom plate. One of the two first face boards has an upper end provided with a first movable plate. The other one of the two first face boards has an upper end provided with a second movable plate. Each of the two second face boards has a lower end provided with a second bottom plate. Each of the two second face boards has an upper end provided with a support plate. The main body is provided with at least one locking slot. The at least one fastening module includes a first fastener member and a second fastener member. The first fastener member of the at least one fastening module is mounted on the second movable plate of the main body. The second fastener member of the at least one fastening module is located in the at least one locking slot of the main body. The second fastener member of the at least one fastening module is detachably connected with the first fastener member.

According to the primary advantage of the present invention, the first fastener member of the at least one fastening module is directly locked onto or unlocked from the second fastener member, such that the carton box is closed or opened easily and quickly, thereby facilitating the user closing or opening the carton box.

According to another advantage of the present invention, the user does not have to break the at least one fastening module to open the carton box, such that the carton box is directly opened without breaking the outer appearance of the carton box, thereby enhancing the aesthetic quality of the carton box.

According to a further advantage of the present invention, the carton box is reused and recycled to achieve an environmental protection.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
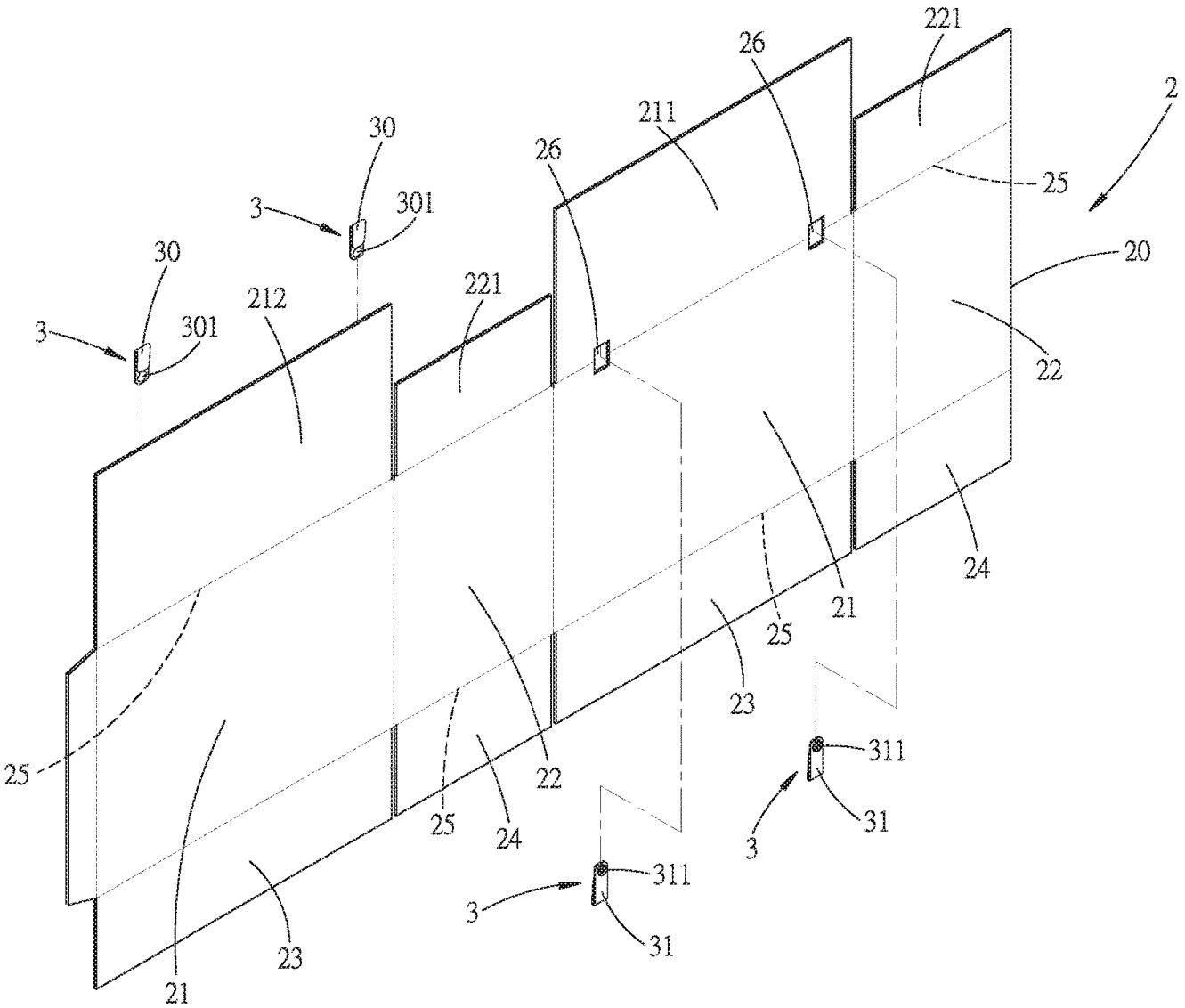
FIG. 1 is an exploded perspective view of a carton box in accordance with the preferred embodiment of the present invention.
Figure 2:
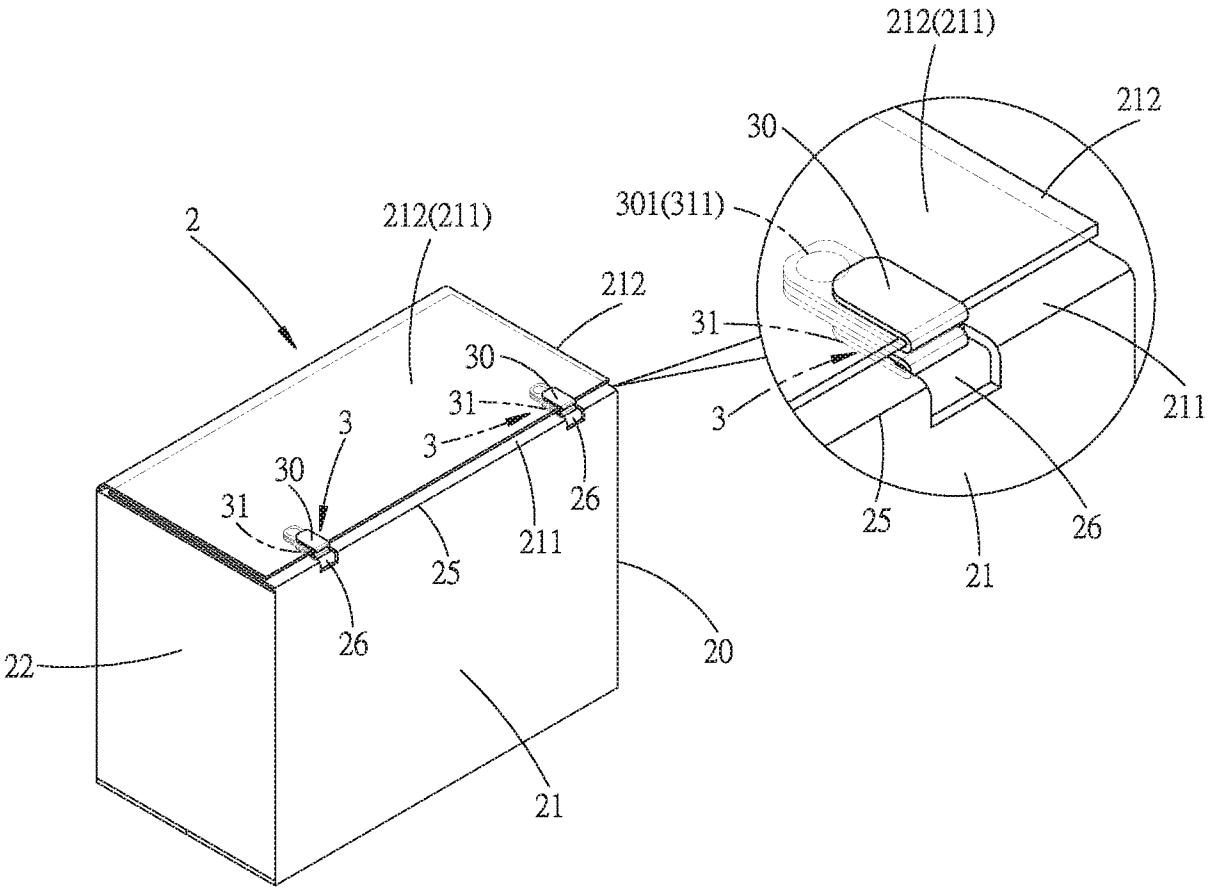
FIG. 2 is a perspective assembly view and a locally enlarged view of the carton box in accordance with the preferred embodiment of the present invention.

Referring to the drawings and initially to FIGS. 1 and 2, a carton box 2 in accordance with the preferred embodiment of the present invention comprises a main body 20 and at least one fastening module 3 removably mounted on the main body 20.

The main body 20 includes two opposite first face boards 21 and two opposite second face boards 22. The main body 20 is integrally formed with the two first face boards 21 and the two second face boards 22. Each of the two first face boards 21 is located between the two second face boards 22. Each of the two first face boards 21 has a lower end provided with a first bottom plate 23 that is foldable. One of the two first face boards 21 has an upper end provided with a first movable plate 211 that is foldable. The other one of the two first face boards 21 has an upper end provided with a second movable plate 212 that is foldable. The second movable plate 212 is opposite to the first movable plate 211 and covers the first movable plate 211. Each of the two second face boards 22 is located between the two first face boards 21. Each of the two second face boards 22 has a lower end provided with a second bottom plate 24 that is foldable. Each of the two second face boards 22 has an upper end provided with a support plate 221 that is foldable. The main body 20 is provided with at least one locking (or snap-fit) slot 26.

The at least one fastening module 3 includes a first fastener member 30 and a second fastener member 31. The first fastener member 30 of the at least one fastening module 3 is mounted on the second movable plate 212 of the main body 20. The second fastener member 31 of the at least one fastening module 3 is mounted on the first movable plate 211 of the main body 20 and is located in the at least one locking slot 26 of the main body 20. The second fastener member 31 of the at least one fastening module 3 is detachably connected with the first fastener member 30.

In the preferred embodiment of the present invention, the at least one locking slot 26 of the main body 20 is directly formed in one of the two first face boards 21 and the first movable plate 211.

In the preferred embodiment of the present invention, the at least one locking slot 26 of the main body 20 is formed in a connection of one of the two first face boards 21 and the first movable plate 211.

In the preferred embodiment of the present invention, the first fastener member 30 of the at least one fastening module 3 is a U-shaped clip secured to the second movable plate 212 of the main body 20 and provided with a male snap 301. The second fastener member 31 of the at least one fastening module 3 is a U-shaped clip secured to the first movable plate 211 of the main body 20 and provided with a female snap 311. The male snap 301 is removably connected with the female snap 311.

In another preferred embodiment of the present invention, the first fastener member 30 and the second fastener member 31 of the at least one fastening module 3 are made of magnetically attractive material and attract each other magnetically.

In another preferred embodiment of the present invention, the first fastener member 30 and the second fastener member 31 of the at least one fastening module 3 are made of hook and loop fasteners.

In the preferred embodiment of the present invention, the carton box 2 comprises two fastening modules 3, and the main body 20 is provided with two locking slots 26.

In the preferred embodiment of the present invention, the main body 20 is provided with a fold section 25 extending through the two first face boards 21, the two second face boards 22, the first movable plate 211, the second movable plate 212, the support plate 221, the first bottom plate 23, and the second bottom plate 24. Thus, the first movable plate 211 and the second movable plate 212 are bent and folded along the fold section 25. Preferably, the at least one locking slot 26 of the main body 20 is formed on the fold section 25 between one of the two first face boards 21 and the first movable plate 211.

In the preferred embodiment of the present invention, the main body 20 is a cardboard sheet integrally formed with the two first face boards 21, the two second face boards 22, the first movable plate 211, the second movable plate 212, the support plate 221, the first bottom plate 23, and the second bottom plate 24.

In assembly, the two first face boards 21 and the two second face boards 22 are folded along the fold section 25, to construct four walls of the main body 20. Then, the first bottom plates 23 and the second bottom plates 24 are folded along the fold section 25, to close the bottom of the main body 20. At this time, the first movable plate 211, the second movable plate 212, and the support plate 221 construct a top opening of the main body 20. Then, the first fastener member 30 of the at least one fastening module 3 is secured to the second movable plate 212 of the main body 20, and the second fastener member 31 of the at least one fastening module 3 is secured to the first movable plate 211 of the main body 20 and is located in the at least one locking slot 26 of the main body 20. Then, the support plates 221 of the two second face boards 22 are folded along the fold section 25. Then, the first movable plate 211 is folded along the fold section 25, and the second movable plate 212 is folded along the fold section 25 and rests on the first movable plate 211. At this time, the first fastener member 30 of the at least one fastening module 3 is locked onto the second fastener member 31 as shown in FIG. 2, such that the second movable plate 212 is positioned on the first movable plate 211. Thus, the carton box 2 is packaged and closed easily and quickly.

When the user wishes to open the carton box 2, the first fastener member 30 of the at least one fastening module 3 is driven by the user and is detached from the second fastener member 31, to unlock the at least one fastening module 3, such that the second movable plate 212 is removed from the first movable plate 211. Then, the second movable plate 212, the first movable plate 211, and the support plates 221 are in turn expanded, to open the top opening of the main body 20, to facilitate the user taking the articles or goods in the main body 20.

When the user wishes to close the carton box 2 again, the support plates 221, the first movable plate 211, and the second movable plate 212 are in turn folded and covered, while the first fastener member 30 of the at least one fastening module 3 is locked onto the second fastener member 31, such that the second movable plate 212 is positioned on the first movable plate 211, so as to close the carton box 2 again.

Accordingly, the first fastener member 30 of the at least one fastening module 3 is directly locked onto or unlocked from the second fastener member 31, such that the carton box 2 is closed or opened easily and quickly, thereby facilitating the user closing or opening the carton box 2. In addition, the user does not have to break the at least one fastening module 3 to open the carton box 2, such that the carton box 2 is directly opened without breaking the outer appearance of the carton box 2, thereby enhancing the aesthetic quality of the carton box 2. Further, the carton box 2 is reused and recycled to achieve an environmental protection.

Figure 3:
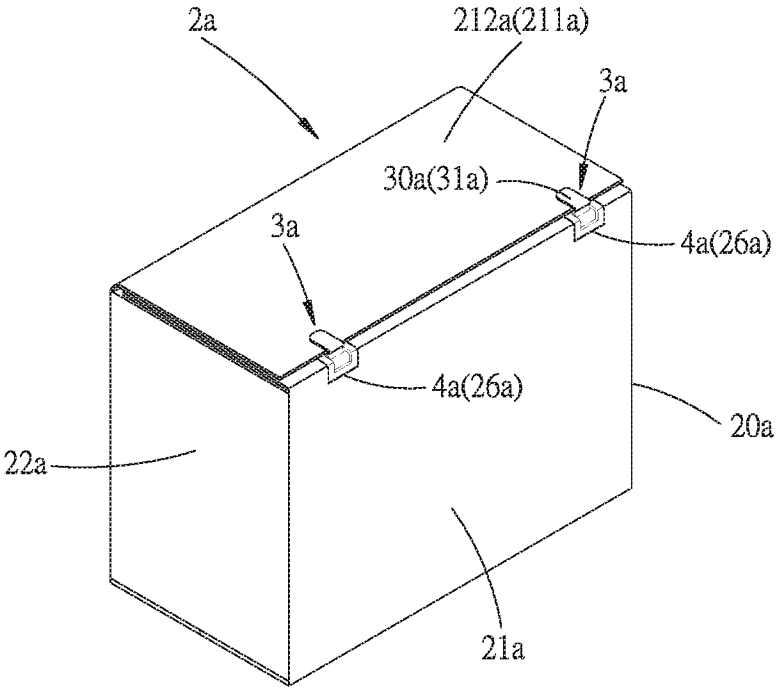
FIG. 3 is a perspective assembly view of a carton box in accordance with another preferred embodiment of the present invention.

Referring to FIG. 3 with reference to FIGS. 1 and 2, a carton box 2*a* in accordance with another preferred embodiment of the present invention comprises a main body 20*a* and at least one fastening module 3*a* removably mounted on the main body 20*a*. The main body 20*a* includes two opposite first face boards 21*a* and two opposite second face boards 22*a*. One of the two first face boards 21*a* has an upper end provided with a first movable plate 211*a*. The other one of the two first face boards 21*a* has an upper end provided with a second movable plate 212*a*. The main body 20*a* is provided with at least one locking slot 26*a*. The at least one fastening module 3*a* includes a first fastener member 30*a* and a second fastener member 31*a*. The carton box 2*a* further comprises at least one ornamental patch 4*a* mounted in the at least one locking slot 26*a* to cover the at least one locking slot 26*a* and the second fastener member 31*a*.

Figure 4:
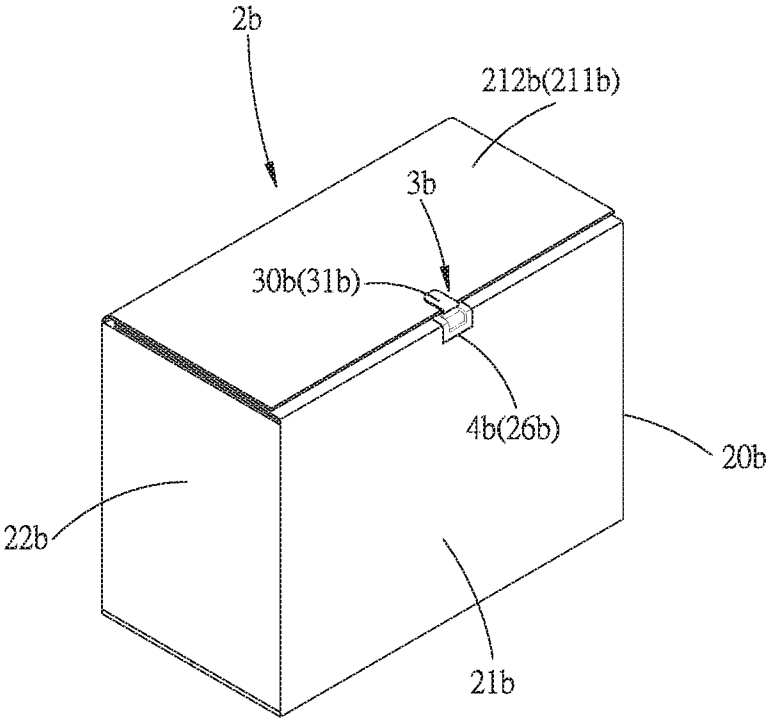
FIG. 4 is a perspective assembly view of a carton box in accordance with a further preferred embodiment of the present invention.
Figure 5:
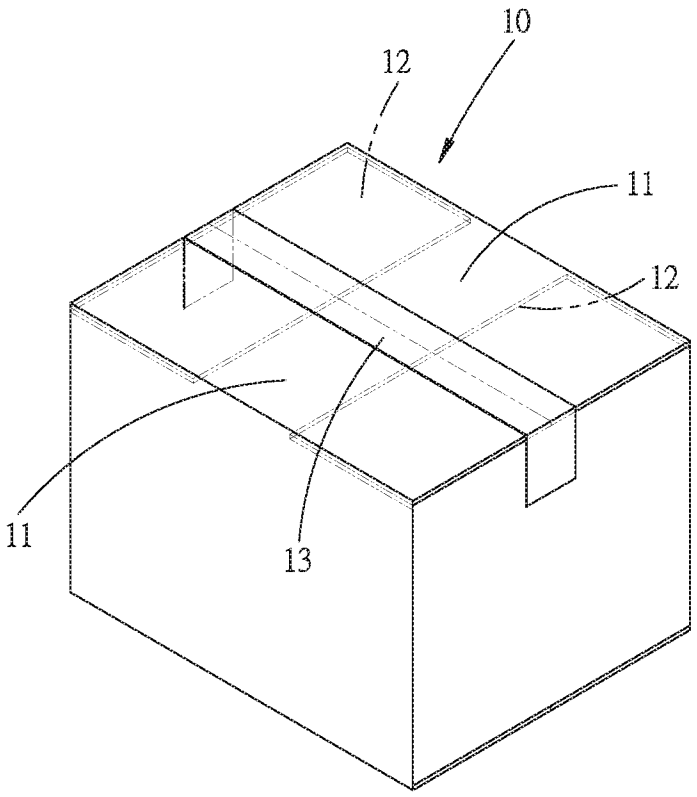
FIG. 5 PRIOR ART
FIG. 5 is a perspective view of a conventional carton box in accordance with the prior art.

Referring to FIG. 4 with reference to FIGS. 1-3, a carton box 2*b* in accordance with a further preferred embodiment of the present invention comprises a main body 20*b* and a fastening module 3*b* removably mounted on the main body 20*b*. The main body 20*b* includes two opposite first face boards 21*b* and two opposite second face boards 22*b*. One of the two first face boards 21*b* has an upper end provided with a first movable plate 211*b*. The other one of the two first face boards 21*b* has an upper end provided with a second movable plate 212*b*. The main body 20*b* is provided with at least one locking slot 26*b*. The fastening module 3*b* includes a first fastener member 30*b* and a second fastener member 31*b*. The carton box 2*b* further comprises an ornamental patch 4*b* mounted in the locking slot 26*b* to cover the locking slot 26*b*.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A carton box comprising:

a main body; and at least one fastening module removably mounted on the main body;

wherein:

the main body includes two opposite first face boards and two opposite second face boards;

each of the two first face boards has a lower end provided with a first bottom plate;

one of the two first face boards has an upper end provided with a first movable plate;

the other one of the two first face boards has an upper end provided with a second movable plate;

each of the two second face boards has a lower end provided with a second bottom plate;

each of the two second face boards has an upper end provided with a support plate;

the main body is provided with at least one locking slot;

the at least one locking slot of the main body is directly formed in one of the two first face boards and the first movable plate;

the at least one fastening module includes a first fastener member and a second fastener member;

the first fastener member of the at least one fastening module is mounted on the second movable plate of the main body;

the second fastener member of the at least one fastening module is located in the at least one locking slot of the main body; and the second fastener member of the at least one fastening module is detachably connected with the first fastener member.

2. The carton box as claimed in claim 1, wherein the at least one locking slot of the main body is formed in a connection of one of the two first face boards and the first movable plate.

3. The carton box as claimed in claim 1, wherein:

the first fastener member of the at least one fastening module is a clip secured to the second movable plate of the main body and provided with a male snap;

the second fastener member of the at least one fastening module is a clip secured to the first movable plate of the main body and provided with a female snap; and the male snap is removably connected with the female snap.

4. The carton box as claimed in claim 1, wherein the first fastener member and the second fastener member of the at least one fastening module are made of magnetically attractive material and attract each other magnetically.

5. The carton box as claimed in claim 1, wherein the first fastener member and the second fastener member of the at least one fastening module are made of hook and loop fasteners.

6. The carton box as claimed in claim 1, further comprising:

at least one ornamental patch mounted in the at least one locking slot.

* * * * *